US005485356A

United States Patent [19]

Nguyen

[11] Patent Number: 5,485,356

[45] Date of Patent: Jan. 16, 1996

[54] RECEPTACLE POWER INDICATOR

[76] Inventor: Duc H. Nguyen, 109 Wake Robin Cir., Spartanburg, S.C. 29301

[21] Appl. No.: 337,766

[22] Filed: Nov. 14, 1994

[51] Int. Cl.[6] ..... F21V 33/00

[52] U.S. Cl. ..... 362/95; 174/66

[58] Field of Search ..... 362/95; 174/66

[56] References Cited

U.S. PATENT DOCUMENTS

| | | |
|---|---|---|
| 1,245,068 | 10/1917 | Thomas . |
| 1,720,463 | 7/1929 | Both . |
| 2,045,199 | 6/1936 | Petersen . |
| 2,385,620 | 9/1945 | Fleckenstein . |
| 2,612,597 | 9/1952 | Sherrard . |
| 2,696,607 | 12/1954 | Witkin . |
| 3,265,888 | 8/1966 | Adolphson . |
| 3,530,337 | 9/1970 | Moore . |
| 4,255,780 | 3/1981 | Sakellaris . |
| 4,617,613 | 10/1986 | Rice . |
| 4,755,913 | 7/1988 | Sleveland . |
| 4,774,641 | 9/1988 | Rice . |

*Primary Examiner*—Carroll B. Dority

*Attorney, Agent, or Firm*—Leatherwood Walker Todd & Mann

[57] ABSTRACT

A receptacle power indicator for use in connection with a receptacle. Contact members are provided on the sides of a receptacle and provide contact surfaces laterally displaced from the receptacle. A cover plate having contact arms outwardly extending from a back portion thereof engage the contact surfaces of the contact members to energize an indicator light provided on the contact plate, thereby indicating whether the receptacle is energized.

17 Claims, 7 Drawing Sheets

RECEPTACLE POWER INDICATOR

BACKGROUND OF THE INVENTION

This invention relates generally to a device for indicating whether an electrical receptacle is energized.

A common problem in household and industry arises when it is necessary to determine whether a particular wall switch or wall receptacle is part of a specific electrical circuit. One commonly used method in determining whether a particular electrical device, such as a wall receptacle, is part of a circuit involves the use of two people. One person is positioned near the receptacle with a voltmeter or "multimeter", or perhaps another electric device which is switched to its "on" position, while the other person is positioned adjacent a circuit breaker box. The person adjacent the breaker box then begins to switch breaker switches in the box one by one from an "on" to an "off" position until the person near the receptacle shouts out, or through use of a walkie-talkie radio, or the like, notifies the person near the breaker box that the breaker for the proper circuit has been found. This, of course, is determined by the person near the outlet recognizing when either the multimeter or the electrical device no longer receives power. As can be seen, this is a cumbersome, crude method of locating the circuit for a particular receptacle, but this method is commonly used.

For safety reasons, it is critical that before work can be done on a receptacle the circuit containing the receptacle is de-energized. That is why selection and de-energization of the correct circuit is so critical. Also, there may be times when it is desirable to de-energize a series of selected receptacles simultaneously, which further complicates locating the particular circuits for the receptacles, as one or more of the receptacles may share a common circuit.

In addition to isolating a circuit for a receptacle when the receptacle is to be replaced or repaired, another important reason to isolate the circuit arises when a particular electrical appliance is not working properly. In order to determine whether the appliance itself or the receptacle is defective, it becomes extremely useful to know whether the receptacle is actually energized. In many situations, this can only be determined by going through the above, or similar, process which requires the trial and error actuation of circuit breaker switches at the circuit breaker box. Locating particular receptacle circuits in an industrial environment can be complicated even further in that a variety of receptacles may be provided for the same work area, with individual or groups of such receptacles being on differing circuits.

It would also be helpful to provide means for quickly locating a receptacle in a residential or commercial environment. Location of receptacles may be complicated by the use of decorative, painted, or matching wallpaper-covered receptacle cover plates.

Devices have been patented which relate to locating electrical receptacles. U.S. Pat. No. 4,617,613, issued to Rice, discloses an illuminated mounting plate having spring-biased electric contacts for directly engaging with terminal screwheads in the side of a conventional receptacle. A resistor is connected to the spring-biased contacts, and a wire connects the resistor to a lamp, visible through a lamp housing provided on the cover plate. U.S. Pat. No. 4,774,641, also issued to Rice, discloses an illuminated electric outlet cover having bifurcated blades which are inserted into a conventional electric outlet for illuminating a lamp provided on the plate.

U.S. Pat. No. 3,265,888, issued to Adolphson, discloses a lighted receptacle having a neon lamp positioned in each outlet for illuminating the outlet in dark environments and also for indicating whether the receptacle is energized. U.S. Pat. No. 4,755,913, issued to Sleveland, discloses a light-emitting diode ("LED") for use in connection with a wall switchplate. A green LED indicates that the circuit is energized to carry current, and a red LED indicates that the switch is on.

U.S. Pat. No. 4,255,780, issued to Sakellaris, discloses an illumination assembly which can be used with switchplates and receptacle plates. Optical fiber means extend from an illumination source and are received in a hollow threaded shaft of an illumination display means, which is threadingly received in the conventional threaded hole provided in a metal mounting box. U.S. Pat. No. 2,385,620, issued to Fleckenstein, discloses an elongated receptacle cover having metal strips connectable with the outlet for energizing pilot lights. And, U.S. Pat. No. 2,612,597, issued to Sherrard, discloses an illuminated outlet device having a lamp provided in the outlet housing.

While the foregoing designs are known, there still exists a need for a practical, economical, and easy-to-install device for determining the circuit affiliation of a receptacle.

SUMMARY OF THE INVENTION

It is, therefore, the principal object of this invention to provide a receptacle power indicator for indicating the circuit affiliation of a receptacle.

It is another object of the present invention to provide a receptacle power indicator which can be used with a conventional receptacle.

It is another object of the present invention to provide a receptacle power indicator which can be easily retrofitted onto an existing, installed receptacle.

It is yet another object of the present invention to provide a receptacle power indicator using a low voltage illumination system which is relatively safe and which uses an insignificant amount of electrical power.

It is still another object of the present invention to provide a receptacle power indicator having a color-coded indicator, or series of indicators, for identifying the specific circuit to which the receptacle is connected.

It is another object of the present invention to provide a method for installing a receptacle power indicator on a power receptacle.

It is still further an object of the present invention to provide a receptacle having integral conductive contact portions.

These and other objects are met by the present invention, which generally includes an indicator for use in connection with an electrical receptacle to indicate electrical energization of the receptacle, the receptacle having first and second sides and at least one terminal connector on each of the first and second sides for receiving an electrical power wire. The indicator includes a first contact member associated with the terminal connector on the first side of the receptacle, and a second contact member associated with the terminal connector on the second side of the receptacle.

A cover plate is provided connectable to the receptacle, the cover plate having a front side and a back side opposite the front side. Cover plate contact means are connected to the cover plate for contacting each of the first and second contact members upon connection of the cover plate to the receptacle. Additionally, annunciator means are connected to the cover plate contact means for annunciating energization of the receptacle upon electrical current being supplied to the receptacle, when the cover plate contact means contacts the first and second contact members.

More specifically, the present invention may include first and second contact members which each have a conductive bottom portion and a conductive top portion and an electrical connector, preferably a resistor, connected therebetween. The cover plate includes outwardly extending contact arms which contact the first and second contact members upon installation of the cover plate on the receptacle. The contact arms are provided with contact surfaces which conductively engage with the first and second contact members. Electrical connections are provided between the contact arms and an indicator light on the front of the cover plate such that upon attachment of the cover plate to the receptacle, the contact portions of the contact arms allow current to flow to and illuminate the indicator light, thereby signalling that the receptacle is energized.

A method of installing a receptacle power indicator system of the present invention on a conventional receptacle is also disclosed.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
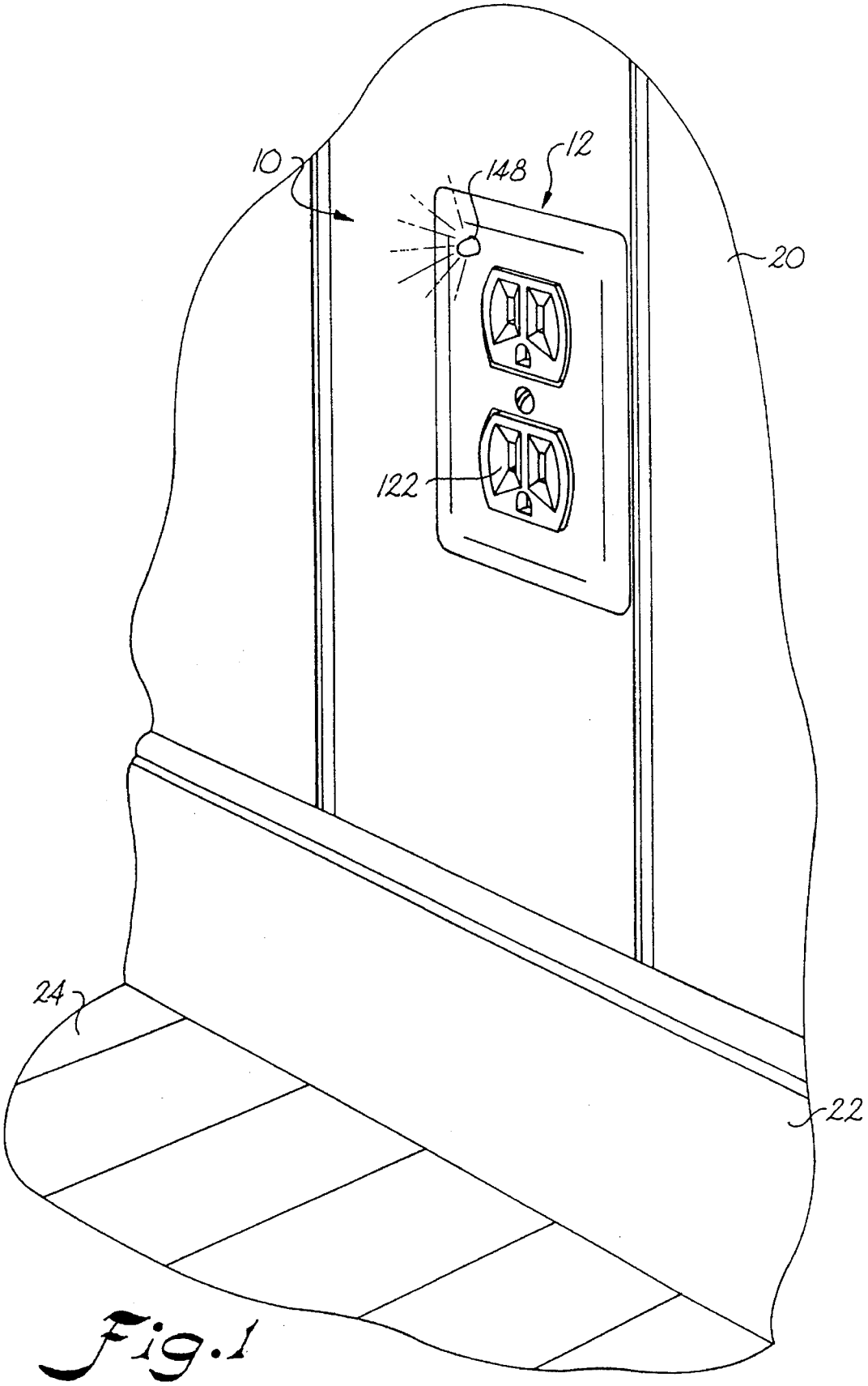
FIG. 1 is a perspective view of a receptacle power indicator system constructed in accordance with the present invention.

The accompanying drawings and the description which follows set forth this invention in a preferred embodiment. However, it contemplated that persons generally familiar with electrical devices will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the receptacle power indicator system of the present invention is indicated generally in the figures by reference character 10.

Figure 2:
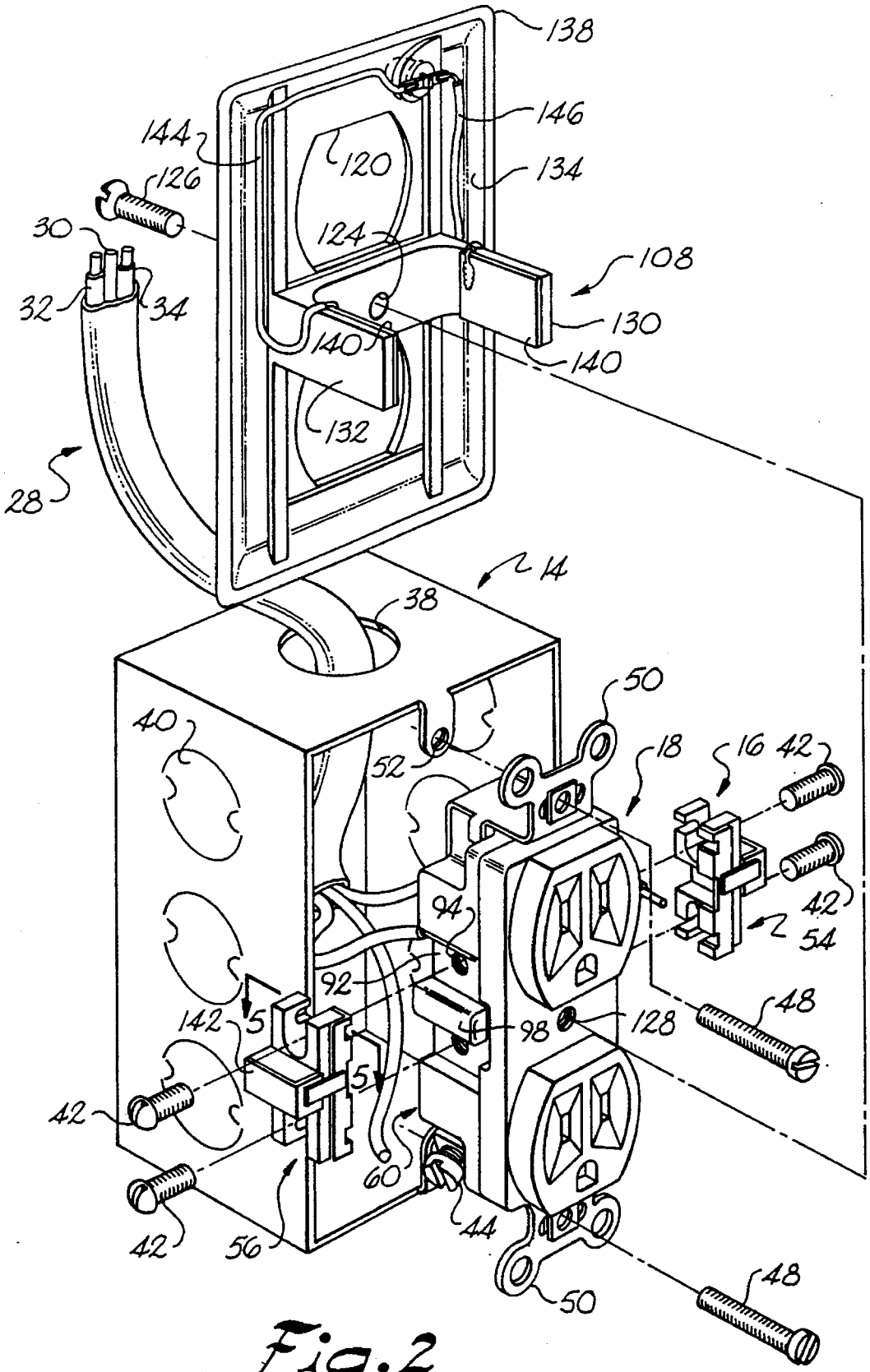
FIG. 2 is an exploded perspective view of a receptacle power indicator system constructed in accordance with the present invention.
Figure 3:
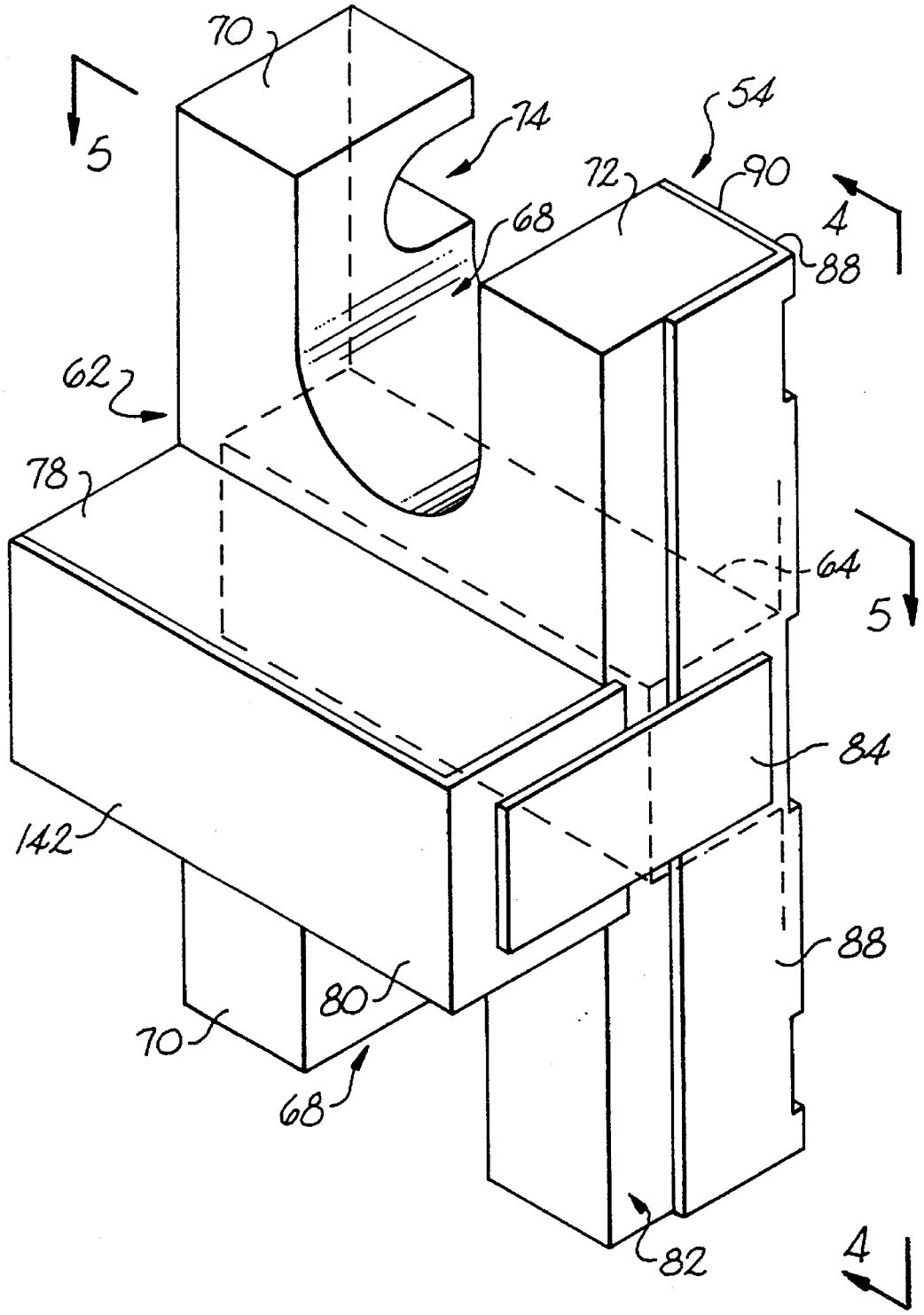
FIG. 3 is perspective view of a contact member constructed in accordance with the present invention.

Turning to FIGS. 1 and 2, the receptacle power indicator 10 of the present invention is illustrated in use with a cover plate, generally 12, wall box, generally 14, two contact members, generally 16, and a conventional receptacle, generally 18. FIG. 1 illustrates the outward appearance of the receptacle power indicator system 10 after it has been installed with a conventional wall receptacle 18, provided in a wall 20, a baseboard 22, and flooring 24 bordering the wall 22.

The construction and assembly of the receptacle power indicator system 10 taught by the present invention is shown generally in FIG. 2. The wall box 14 can be of conventional design and is typically provided with a power cable, generally 28, containing three wires 30, 32, 34. One of the wires is typically a ground wire 30, while the other two wires 32, 34 are power wires. The power cable 28 is introduced into the wall box 14 through a cable opening 38 provided in the wall box. The power cable can be introduced into the ends, sides, or back of the wall box 14 by simply selecting and removing one of the knock-outs 40 provided in the wall box. Typically, the power wires 32, 34 are run to the receptacle 18, with one power wire 32 being connected to each side of the receptacle and engaged by a terminal connector, or, screw 42. The ground wire 30 is typically connected to the ground connector lug 44 20 also provided on the receptacle. Attachment screws 48 are used to connect the receptacle, through engagement with attachment ears 50 provided on the ends of the receptacle, to threaded flanges 52 provided on the wall box, thereby seating the receptacle within the wall box.

While the above generally describes the installation of a conventional receptacle into a wall box, this procedure is modified by using components of the present invention. The present invention includes the use of two contact members, generally 54, 56, one of which being attached to each side 60 of the receptacle. The contact members 54, 56, an example of which is illustrated in FIGS. 3 through 7A, could be mirror images of one another, although they are preferably of identical configuration with respect to one another.

Figure 4:
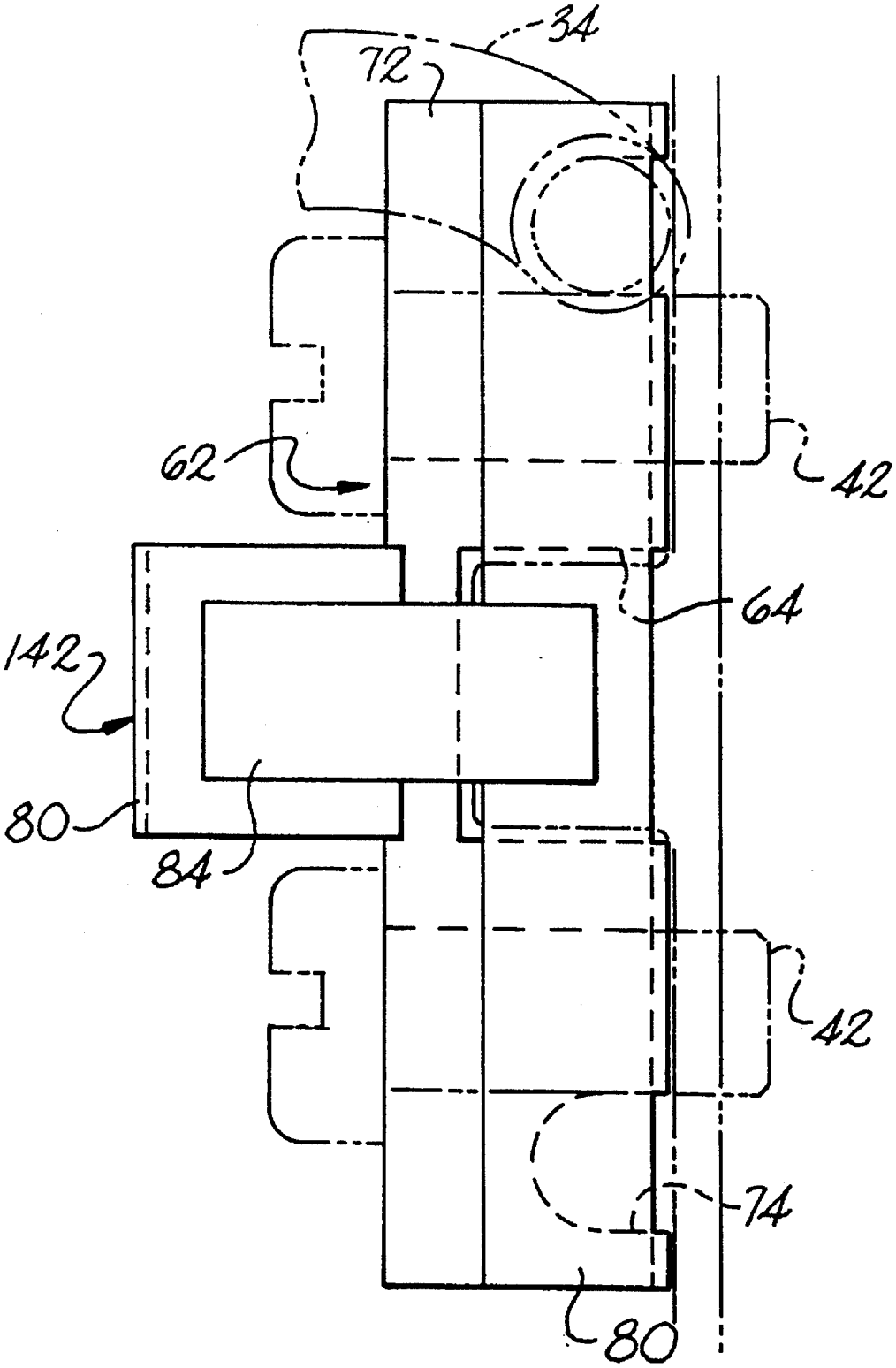
FIG. 4 is a sectional view taken along lines 4—4 of FIG. 3.
Figure 5:
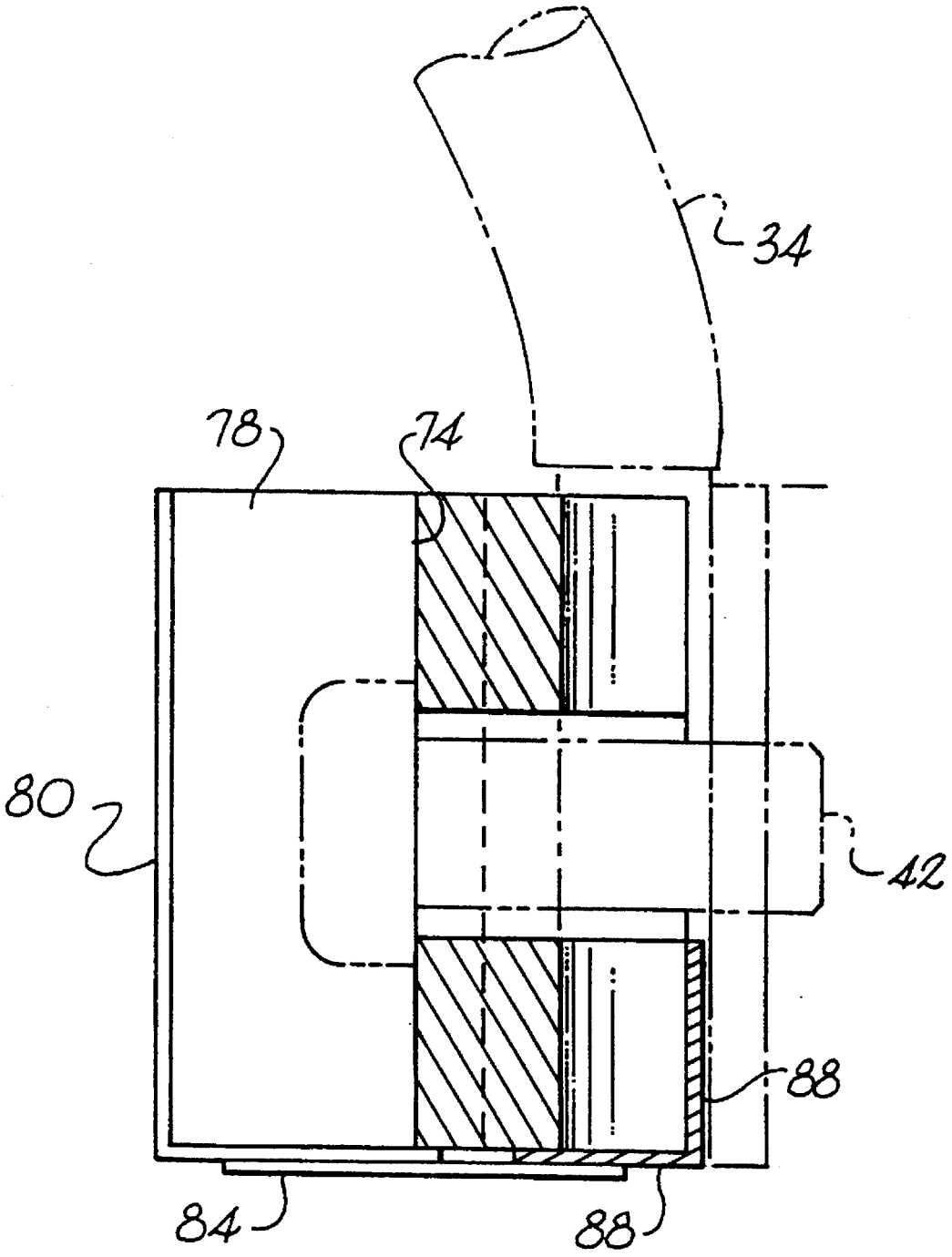
FIG. 5 is a sectional view taken along lines 5—5 of FIG. 3.

In the embodiment illustrated in FIGS. 3 through 6, each contact member is of a generally inverted T-shape in longitudinal cross section. Each contact member includes an elongated base portion, generally 62, having a transversely running tunnel 64 provided therein and two longitudinally extending terminal openings, or slots 68, provided approximately in the central portion of each end of the base member 62. The terminal screw slots 68 help define two legs 70, 72 on each end of the base member 62, which are spaced apart from one another by the terminal screw slot 68 and which extend substantially parallel to one another. Defined in at least one of the legs is a transversely running wire access recess 74 for allowing, as shown in FIG. 5, access of a power wire to a receptacle terminal screw 42, in a manner which will be discussed in further detail below.

Each contact member 54, 56 also includes a transversely running ridge portion 78 attached to the base member 62. Attached to the ridge portion is an L-shaped contact plate 80 which extends along the outer surface of the ridge portion 78 and along a contact side 82 of the contact member.

Connected to the contact plate is a semiconductor-type resistor chip 84, which bridges a gap between the L-shaped contact plate 80 and a conductor plate 88, which is also substantially L-shaped in cross section. Conductor plate 88 runs substantially the length of the contact side 82 of the base member and also extends onto the bottom 90 of the base member for electrically contacting a power wire, terminal screw, or adjoining conductive contact surface adjacent the terminal screw of a receptacle.

In the embodiment of the contact member 16 shown in FIGS. 3 through 7A, the contact member is preferably molded from a plastic material, such as nylon, or some other suitable non-conductive material, and is of a one-piece unitary construction. It is to be understood, however, that the contact member could be made of any of a variety of other electrically conductive or non-conductive materials, if desired. Further, the contact member could be constructed through machining, stamping, or through other manufacturing means, if desired. Contact plate 80 and conductor plate 88 are preferably molded into place when the contact member is being molded. However, such plates 80, 88 could be applied later, after the molding process, if desired. For example, the contact and conductor plates 80, 88 could be attached to the contact member through use of an electrically conductive adhesive, or could be attached by a mechanical fastening means, such as through screws, rivets, bolts, or the like. Resistor chip 84 could also be attached to plates 80, 88 by a variety of means, such as through soldering, use of conductive adhesive, or mechanical fastening means.

In attaching contact members 54, 56 to the sides of the receptacle, each contact member is brought against the side of the receptacle such that a power wire passes through at least one of the wire access recesses 74 and is adjacent to one of the terminal screws 42. The end of the power wire is then curled such that it will encircle or partially encircle a terminal screw 42, and the terminal screw is then tightened. Another terminal screw 43 is also provided on the other end of the contact member, and an additional power wire could also be provided under that end of the contact member in like manner, although such is not normally the case. Typically, because of a conductive jumper 92 between the two terminal screw openings 94 on the side of a conventional receptacle, the power wire need only be connected to one of the two terminal screws on each side of the receptacle for both outlets to be operable. The conductor plate 88 of the contact member is designed to make contact with the jumper plate and/or the power wire and/or the terminal screw in such a manner that an electrical contact is securely made between the power wire and the conductor plate. Installation of the contact member on the other side of the receptacle is carried out in like manner as discussed above.

As shown in FIGS. 2 and 4, the tunnel 64 extending the width of the contact member is designed to receive an upstanding divider wall 98 provided on the sides of a conventional receptacle for isolating the terminal screws from one another. By providing the tunnel, the base portions of the contact member will securely seat in an electrically conductive manner against the sides of the receptacle. Further, by providing the wire access recesses, the contact members will seat in a substantially parallel manner with respect to the side of the receptacle to produce substantially vertically disposed, or horizontally disposed if the receptacle is mounted horizontally, contact surfaces once the contact members are installed. As illustrated in FIG. 7A, instead of the tunnel-type wire access recess 74 configuration, an undercut recess 100 can be provided on the ends on the contact member 16' for allowing clearance for the power wires. This allows for substantially flat seating of the contact member on the receptacle sides. While the wire access recesses and undercut recesses have been illustrated as providing clearance for the power wires, the contact member of the present invention could also be constructed without such accommodations being given for power wire clearance, if desired, as shown in FIG. 6.

Figure 6:
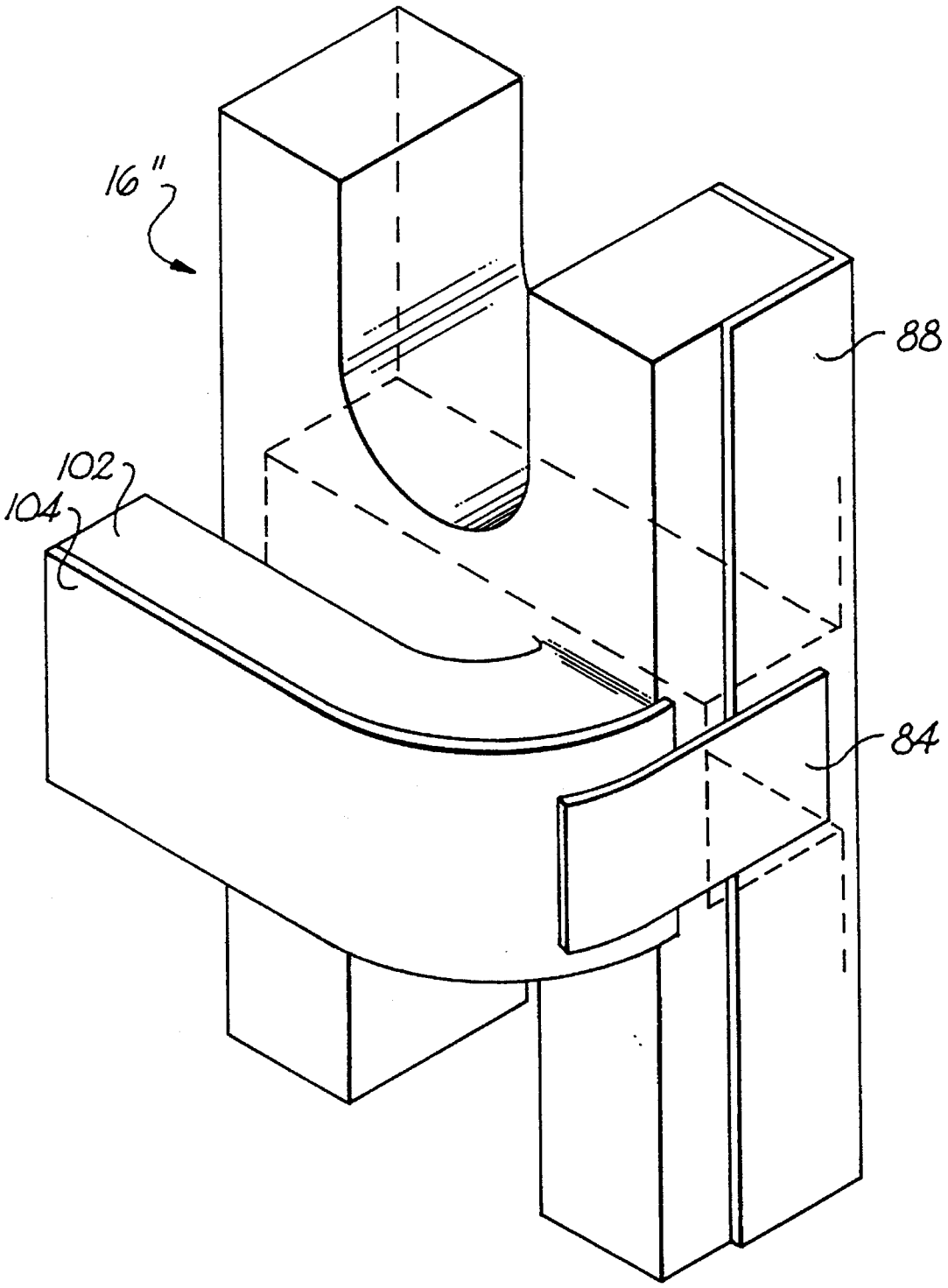
FIG. 6 is a perspective view of an alternate embodiment of a contact member indicator constructed in accordance with the present invention.

A further embodiment of a contact member 16" constructed in accordance with the present invention is illustrated in FIG. 6, wherein instead of the transverse-running ridge portion 78 being provided on the base portion of the contact member, a cantilevered, curved arm 102 could be instead provided having a correspondingly curved contact plate 104. The curvature provided by the contact plate and cantilevered arm 102 could enhance contact of contact arms, generally 108, therewith, the contact arms 108 being provided on the back of a cover plate 12 constructed in accordance with the present invention, and which will be discussed in further detail below.

Figure 7:
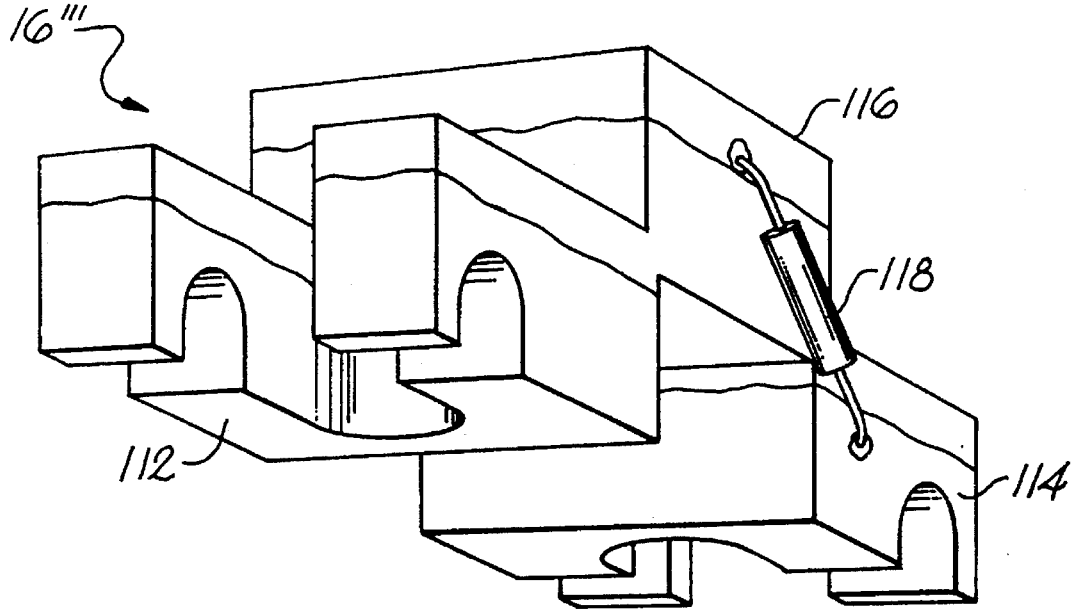
FIG. 7 is a perspective view of a further alternate embodiment of a contact member indicator constructed in accordance with the present invention.
Figure 7A:
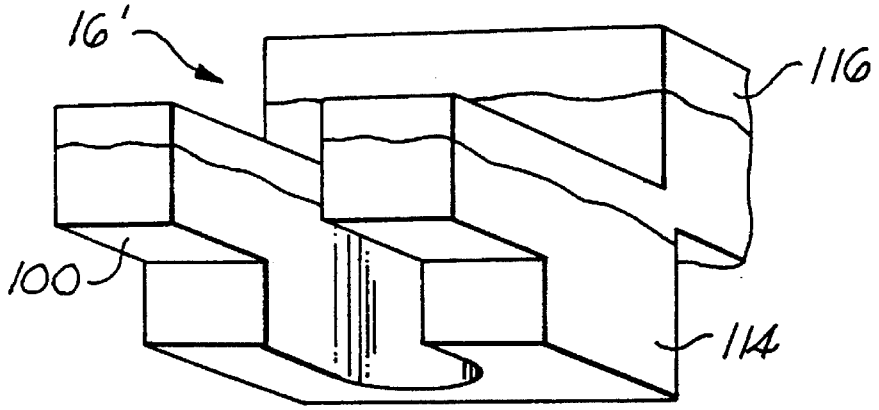
FIG. 7A is a partial perspective view of a still further alternate embodiment of a contact member indicator constructed in accordance with the present invention.

In the alternate embodiment illustrated in FIG. 7, the contact member 16''' can be constructed of a non-conductive material, and then have the bottom and top portions thereof dipped into or plated with a conductive material. This would provide for conductive bottom services 112 and conductive side services 114 of the contact member and also provide for a conductive top surface 116 of the contact member. A separate conventional resistor 118 could then be soldered to the conductive top and side surfaces 114, 116 of the contact member to make an electrical connection therebetween, if desired. The resistor could also be attached by a conductive adhesive, or a resistor chip attached by soldering, conductive adhesive, or other means, such as that disclosed above could also be used. Further, although not illustrated, the entire contact member could be constructed of conductive material or coated with conductive material, if desired, and the resistor eliminated from the contact member. The resistor could then be provided, if at all, with the cover plate structure.

The cover plate structure 12, which is used in connection with the contact members discussed above, will now be discussed in more detail. The cover plate structure 12 includes outlet openings 120 for communicating with the outlets 122 of the receptacle and also a central connector opening 124 for receipt of a cover plate mounting screw 126, which is received by a threaded bore 128 provided in the receptacle. Cover plate structure 12 includes outwardly extending contact arms 130, 132 projecting from the back side 134 of the cover plate 138. These contact arms 130,132 include conductive contact plates 140. The contact arms are designed to be somewhat resilient and flexible such that upon attachment of the cover plate 138 to the receptacle, the contact plates 140 of the contact arms will snugly engage the contact surfaces 142 of the contact members.

It is to be understood that although a conventional receptacle has been illustrated, to which the contact members 16 are attached, the present invention may also include building in the substantial equivalent of the contact members integral with a receptacle, rather than having separate contact members. In such an embodiment (not shown), electrically conductive contact portions could be provided which perform the same function of contact surfaces 142, in substantially the same way. Such contact portions would be engagable with the contact arms of a cover plate for conducting electricity from the contact portions to the contact arms. Additionally, a resistor could also be built into the receptacle to step down the line voltage to a lesser voltage ultimately available at the contact portions. This modified receptacle is simply one of a variety of versions of the present invention which could be constructed without departing from the spirit or scope of the present disclosure.

The contact arms can be constructed of conductive material, thereby eliminating the contact plates, but are preferably constructed of plastic, or some other suitable material. The cover plate and contact arms can be of molded, unitary construction, or could be separate components which are attached together by conventional fastening means such as by use of adhesive, mechanical fasteners, etc.

Electrically connected to the contact plates, or corresponding contact portions of the contact arms (if the inner portions of the contact arms are constructed to be conductive either through application of a conductive material thereto or by virtue of the contact arms themselves being conductive) are indicator wires 144, 146. One of the indicator wires 144, 146 is attached to each contact plate, and leads to an indicator light 148. The indicator light 148 extends outwardly from the front side of the cover plate, and upon installation of the cover plate on the receptacle, and the receptacle being energized, the indicator light 148 becomes illuminated. Preferably, the indicator light is a light-emitting diode ("LED"), which is typically long-lasting and has a negligible power consumption. It is to be noted that the contact arms 144, 146, if constructed of a conductive material, have non-conductive surfaces or means provided on the outer portions thereof such that the contact arms do not come into contact with the wall box, which oftentimes will be metal. Therefore, it is preferable that the contact arms be constructed of a flexible plastic material and have conductive contact plates attached thereto, or a conductive material applied thereto, so that the risk of short circuiting to a metal wall box is substantially eliminated.

It can be seen that the receptacle power indicator system of the present invention, discussed above, provides a effective and practical means for indicating energization of a particular receptacle. This is particularly useful in determining which receptacles are on a specific circuit. Although not shown, instead of a visual indicator light, a device which generates an audible tone could also be used, instead of or in addition to the indicator light, if desired. Further, other types of indicator lights could be used instead of the LED discussed, and LEDs or lights of a particular color could be used for a particular circuit. For example, a red indicator light could indicate one circuit, a yellow indicator light to indicate another circuit, a blue indicator light to indicate a still further circuit, etc. Also, instead of one indicator light being provided, two or more indicator lights could be provided of the same or differing colors from one another, with each color combination indicating a particular circuit.

As set forth above, a method of providing a receptacle power indicator system includes the installation of the contact members on the sides of a receptacle such that electrical contact is made with contact portions of the contact members. A cover plate assembly having contact arms for engaging the contact surfaces of the contact members is then installed on the receptacle such that the preferably reduced voltage current at the contact surfaces of the contact members, provided through use of the resistor, is communicated to the contact arms and, therefore, to the indicator light.

While the resistor means discussed above could be eliminated, it is strongly suggested that such be used in order to reduce the risk of exposure to line voltage. Instead of being provided on the contact member, a resistor could be provided between the contact arms and the indicator light, if desired, but placement of the resistor on or near the contact member is preferred for safety reasons. Because the indicator is powered through the parallel connection to the terminals of the receptacle, the indicator light can function well without affecting the performance of the receptacle.

During normal operation, the indicator light is illuminated. This facilitates location of a receptacle and also could enhance the appearance of a room containing the receptacle, and could further act as a nightlight-type of device.

It is further noted that although individual wire leads have been shown leading to the indicator light, the conductive lines could also be molded into the cover plate, instead of using individual wires, or conductive lines could be printed onto or otherwise applied, for example, through use of conductive adhesive, if desired.

Additionally, the contact members are designed such that if there is a direct contact between the contact surfaces of a contact member to ground while the receptacle is energized, no significant electrical short circuit should occur because of the resistor, which steps down the voltage to the contact surfaces.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An indicator for use in connection with an electrical receptacle to indicate electrical energization of the receptacle, the receptacle having first and second sides and at least one terminal connector on each of the first and second sides for receiving an electrical wire, the indicator comprising:

a first contact member connectable to the terminal connector on the first side of the receptacle;

a second contact member connectable to the terminal connector on the second side of the receptacle;

a cover plate connectable to the receptacle, the cover plate having a front side and a back side opposite said front side;

cover plate contact means connected to said cover plate for contacting at least one of said first and second contact members upon connection of said cover plate to the receptacle; and annunciator means connected to said cover plate contact means for annunciating energization of the receptacle upon electrical current being supplied to the receptacle, when said cover plate contact means contacts at least one of said first and second contact members.

2. An indicator as defined in claim 1, wherein said first and second contact members each include a non-conductive body portion having a top portion and a bottom portion substantially opposite said top portion; a first electrically conductive portion associated with said top portion; and a second electrically conductive portion associated with said bottom portion.

3. An indicator as defined in claim 2, further comprising a conductive connector member connected to both said first and second conductive portions for conducting electric current therebetween.

4. An indicator as defined in claim 3, wherein said conductive connector member is a resistor device.

5. An indicator as defined in claim 3, wherein said conductive connector member is a semiconductor resistor.

6. An indicator as defined in claim 2, wherein at least one of said first and second conductive portions is a conductive coating applied to said body member.

7. An indicator as defined in claim 2, wherein at least one of said first and second conductive portions is a conductive plate.

8. An indicator as defined in claim 1, wherein at least one of said first and second contact members defines a recess for receiving the electrical wire.

9. An indicator as defined in claim 1, wherein at least one of said first and second contact members defines a slot for receiving the terminal connector of the receptacle.

10. An indicator as defined in claim 1, wherein said cover plate contact means includes first and second contact arms spaced apart from one another, said first contact arm being contactable with said first contact member, and said second contact arm being contactable with said second contact member, upon connection of said cover plate to the receptacle.

11. An indicator as defined in claim 1, wherein said cover plate contact means includes an electrically conductive portion for contacting at least one of said first and second contact members.

12. An indicator as defined in claim 11, further comprising an electrical connector connected to both said annunciator means and said conductive portion of said cover plate contact means.

13. An indicator as defined in claim 1, wherein said annunciator means includes a light emitting diode.

14. An electrical energization indicator, comprising:

a receptacle having first and second sides and at least one terminal connector on each of the first and second sides;

a first conductive contact portion connected to and spaced outwardly from the terminal connector on the first side of the receptacle;

a second conductive contact portion connected to and spaced outwardly from the terminal connector on the second side of the receptacle;

a plate connectable to the receptacle, the plate having a front side and a back side opposite said front side;

at least one contact arm extending rearwardly from said back side of said plate, said contact arm having a contact arm conductor thereon for contacting at least one of said first and second conductive contact portions upon connection of said plate to the receptacle; and an indicator light connected to said contact arm conductor for illuminating upon energization of the receptacle, when said contact arm conductor contacts at least one of said first and second conductive contact portions.

15. A method for providing a receptacle power indicator on an electrical receptacle for indicating electrical energization of the receptacle, the receptacle having first and second sides and at least one terminal connector on each of the first and second sides for receiving an electrical wire, the method comprising:

providing a first contact member and a second contact member;

connecting said first contact member to the first side of the receptacle with a terminal connector and connecting the second contact member with the second side of the receptacle with a terminal connector;

providing a power wire to the terminal connector on each of the first and second sides of the receptacle such that electrical contact is made between each power wire and the respective first and second contact member;

providing a cover plate connectable to the receptacle having cover plate contact means for contacting at least one of said first and second contact members upon connection of said cover plate to the receptacle, said cover plate having annunciator means for annunciating energization of the receptacle; and connecting said cover plate to the receptacle such that said cover plate contact means contacts at least one of said first and second contact members.

16. The method as defined in claim 15, wherein said annunciator means includes a light-emitting diode.

17. The method as defined in claim 15, further comprising: reducing the voltage of the power wire; and delivering the reduced voltage to said annunciator means through said first and second contact members and said cover plate contact means.

* * * * *